US005996832A

United States Patent [19]

Nieuwoudt

[11] Patent Number: 5,996,832

[45] **Date of Patent: *Dec. 7, 1999**

[54] COVER FOR BEVERAGE CAN

[75] Inventor: James George Nieuwoudt, Langenhovenpark, South Africa

[73] Assignee: Henbase 3172 (Proprietary) Limited, Westdene Bloempontein, South Africa

[ * ] Notice: This patent issued on a continued prosecution application filed under 37 CFR 1.53(d), and is subject to the twenty year patent term provisions of 35 U.S.C. 154(a)(2).

[21] Appl. No.: 08/880,635

[22] Filed: Jun. 23, 1997

[30] Foreign Application Priority Data

| | | | |
|---|---|---|---|
| Jun. 26, 1996 | [ZA] | South Africa | 96/5397 |
| Aug. 12, 1996 | [ZA] | South Africa | 96/6789 |
| Aug. 12, 1996 | [ZA] | South Africa | 96/6790 |

[51] Int. Cl.[6] ..... B65D 51/20

[52] U.S. Cl. ..... 220/257; 220/258; 220/523; 206/69; 206/217

[58] Field of Search ..... 220/269, 270, 220/906, 257, 258, 500, 529, 522, 523, 716, 730, 735, 521, 708, 703, 200, 201, DIG. 16, DIG. 17, 256; 215/251, 230, 11.2; 206/216, 217, 459.5, 69; 374/150, 157, 141; 116/216

[56] References Cited

U.S. PATENT DOCUMENTS

| | | | |
|---|---|---|---|
| 2,015,028 | 9/1935 | Gillette | 220/521 X |
| 2,120,403 | 6/1938 | Godfrey | 220/521 X |
| 2,172,842 | 9/1939 | Godfrey | 220/521 |
| 2,243,629 | 5/1941 | Hodgson | 220/521 X |
| 2,383,274 | 8/1945 | Punte | 220/258 |
| 3,112,824 | 12/1963 | Lemelson | 220/521 X |
| 3,567,059 | 3/1971 | Littman | 215/11.2 |
| 3,768,688 | 10/1973 | Linke | 220/522 |
| 4,095,710 | 6/1978 | Tomiati | 220/708 |
| 4,247,016 | 1/1981 | Shaw | 220/708 |
| 4,322,016 | 3/1982 | Barrash | 206/459.5 X |
| 4,643,329 | 2/1987 | Mobberley et al. | 220/257 |
| 4,708,257 | 11/1987 | Deline | 220/257 |
| 4,895,270 | 1/1990 | Main et al. | 220/269 X |
| 4,927,048 | 5/1990 | Howard | 220/257 X |
| 4,990,345 | 2/1991 | Webb | 220/522 X |
| 5,000,581 | 3/1991 | Yata et al. | 215/11.2 X |
| 5,105,964 | 4/1992 | Heath | 220/258 X |
| 5,282,534 | 2/1994 | Lapp | 206/459.5 X |
| 5,316,166 | 5/1994 | Pavely et al. | 220/269 |
| 5,562,205 | 10/1996 | Diaz . | |
| 5,584,388 | 12/1996 | Johnson | 206/217 |
| 5,647,497 | 7/1997 | Labbe | 220/258 X |
| 5,720,555 | 2/1998 | Elele | 220/703 X |
| 5,769,263 | 6/1998 | Willingham et al. | 220/522 |

FOREIGN PATENT DOCUMENTS

| | | | |
|---|---|---|---|
| 474420 | 6/1969 | Switzerland | 220/257 |

*Primary Examiner*—Stephen K. Cronin
*Assistant Examiner*—Nathan Newhouse
*Attorney, Agent, or Firm*—Larson & Taylor

[57] ABSTRACT

Beverage cans often are stored or transported in surroundings which are not hygienic. The result is that a beverage can may reach the end user in a condition, which is not only unattractive but is also unhygienic. The invention provides a cover for assisting in overcoming this problem and, if required, providing additionally or alternatively a promotional advantage. Such as a cover for a dispensing opening of a beverage can includes a disc and an attachment area associated with the disc for attaching the disc removably to a beverage can for closing off the dispensing opening of the beverage can. The invention also is directed to a method for applying the cover to a beverage can.

11 Claims, 8 Drawing Sheets

COVER FOR BEVERAGE CAN

FIELD OF INVENTION

The present invention relates to covers for beverage cans, and to a method for providing such covers to beverage cans.

The beverage cans, may be of the type having a tear-off lug closing off a dispensing opening.

BACKGROUND TO INVENTION

Beverage cans often are stored or transported in surroundings which are not hygienic. The result is that a beverage can may reach the end user in a condition, which is not only unattractive but is also unhygienic.

It is an object of the invention to suggest ways and means for assisting in overcoming this problem and, if required, providing additionally or alternatively a promotional advantage.

SUMMARY OF INVENTION

According to the invention, a cover for a dispensing opening of a beverage can includes a disc and an attachment area associated with the disc for attaching the disc removably to a beverage can for closing off the dispensing opening of the beverage can.

The disc may have an annular ring joined thereto for attachment to a beverage can.

The cover may form part of a lid of a beverage can to be applied to a beverage can after filling of the beverage can.

The cover may be provided with promotional material.

The promotional material may be constituted by a separate member located adjacent the disc.

Also according to the invention, there is provided a cover for a beverage can, which beverage can has a cylindrical housing and a lid part at one end of the cylindrical housing, the cover including a disc constituted by a disc part and a circumferential collar formed integrally therewith, the collar being adapted to fit tightly against an end of the cylindrical housing of a beverage can so that the disc part covers the lid part of the beverage can.

The cover may be provided with a tongue for removal from a beverage can to which the cover is fitted.

Further according to the invention, there is provided a cover for a beverage can, which beverage can has a cylindrical housing and a lid part at one end of the cylindrical housing and a raised rim circumferentially surrounding the lid part, the cover including a disc constituted by a disc part, the disc part being adapted to be fitted over the lid part of a beverage can between the circumferential raised rim of the beverage can so that the disc part covers the lid part of the beverage can.

Yet further according to the invention, a method of covering a dispensing opening in a lid of a beverage can includes the steps of attaching a cover as set out above to a beverage can for closing on the dispensing opening of the beverage can by suitably placing the cover over such a dispensing opening; and of joining the cover removably to the beverage can.

The method may further include the step of providing a separate member between the cover and the lid of a beverage can. The separate member may include any promotional or other information.

The disc may be made of thin and flexible material, for instance of suitable sheet metal foil, a plastics foil or a foil made of any other suitable material.

The disc also may be of a laminated construction comprising at least two sheets, foils or layers laminated together.

Alternatively, or in addition, the disc may have an annular ring joined thereto for attachment to a beverage can.

In case of a disc made of plastics material, it may be applied to a beverage can by heat, glue, laser welding or melting, or merely by frictional fitting.

In case of a disc made of metal it may be applied to a beverage can by mechanical crimping, welding, glueing or merely by frictional fitting.

In the case of a disc made of glass it may be applied to a beverage can by glueing.

The material of the disc may be biodegradable to render it environmentally friendly. It also may be made of edible material and may be tasteless and have no smell.

The material of the disc may be such to render the cover illuminous.

The cover may be used for sterilising, protection, decorative, promotion or for any other purposes.

The cover may form part of a lid of a beverage can to be applied to a beverage can after filling so as to close the can.

The cover may be applied to a beverage can before filling thereof or after filling thereof, and, in the latter case, before or after applying a pasteurising or sterilisation process to the beverage can.

The beverage can may be of round circular shape, and may be made of suitable sheet metal, for instance tin alloy. The beverage may be a carbonated beverage. It may be an alcoholic or nonalcoholic drink.

The beverage can can have opposite closed ends, in one end a tear-off lug being provided for uncovering a dispensing opening.

The cover may function as a trigger for opening the dispensing part of a can. It may replace the existing trigger of a beverage can or can act as a lever mechanism for opening a can. It may also be attached to an existing trigger of a can in order to be partly or wholly used to open a can. It may also be used as any other mechanism for opening of a can.

The cover may be used as a cover for opened cans in order to stop spilling and running down of opened beverages.

The cover itself may act as a drinking straw and/or any mouthpiece for drinking purposes. The mouthpiece may always be visual or only when the cover is removed from a beverage can. The cover may also be used (for instance torn, bent, folded) in any way to act as a mouthpiece for drinking purposes.

The cover may be used to attach any items, such as a drinking straw, a mouthpiece for drinking, a gift, money, a puzzle, chemicals (such as headache and other pills, medicinal items), a game, a tobacco item, a toy, seeds, safety material, or any other useful item. These items may be attached underneath, onto or on top of the body (or between layers).

The cover may be provided with promotional or advertising material, either on or below the cover itself or as a separate item. A separate member may be located between the disc and a beverage can to which it is fitted.

Promotional material may be made from any material such as biodegradable material. The promotional material may be impregnated beforehand for moisture absorption or sterilizing purposes.

The cover may be adapted to activate any promotional item as the cover is opened or removed from a beverage can.

The promotional material may be aimed at promoting or advertising any sport event in any way.

The promotional material may be aimed at promoting or advertising any project (for instance polio, AIDS prevention) in any way, for example a condom may be placed between the can and the lid of a container.

The promotional material may be fixed in any way to the existing trigger mechanism of a can, that is below, through or on top of the trigger mechanism.

The cover may have any two or three dimensional shape for promotional purposes.

The cover may be adapted to release any smell or odour as it is opened. The smell may be for promotional purposes or may give an indication of the quality or type of the beverage or any other purpose.

The cover may be layered and may contain any chemicals or combination of chemicals aimed at cooling or heating the beverage drink or beverage can in any way. An example is a chemical of which the temperature lowers as It is crushed, such as used for sport injuries. In this case the cover may be attached to the bottom of a beverage can or to the top of a beverage can.

The cover or promotional item may be of any colour or combination of colours. The cover or promotional item may also be transparent or translucent. The material may also change colours or images under certain circumstances, for example when it is pressed, rubbed, dropped, or exposed to heat or cold.

The cover material and promotional item can also be used to indicate the temperature of a beverage in a beverage can. This may be by displaying a colour or by giving any other visual or perceivable indication.

The cover material or promotional item may also give an indication of the quality of the beverage in a beverage can. The indication can be visual or any other means perceivable by humans, such as smelling, feeling, seeing a colour or any other display.

The cover and promotional item may reflect the age of the beverage.

The cover may reflect the fact that the cover has or has not been opened or removed before so as to indicate tampering. This is to stop tampering with promotional items.

The cover may be made of multi-layer material that may be or may not be fixed to one another. The promotional items may be placed between the layers of material, or below the layers or on top of the layers of material.

The cover may be impregnated before or after being applied to a beverage can in order to ensure a sterilized attachment.

The cover may be gas permeable so as to allow breathing.

The cover may screw onto the top or bottom of a beverage can.

The promotional material may be slid onto a beverage can before the cover is fitted to the can.

The promotional material may be printed or stamped on a beverage can underneath the cover material.

The cover may be fitted with a tongue or lug for easy opening or partly or fully removing the cover or for uncovering the promotional material. The tongue or lug may form part of the cover or may be a separate part which is fixed to a beverage can.

In some uses the cover should not be easily removable. According to one suggestion, the cover must be destroyed if it is removed.

A removal strip may be located between the cover and the lid of a beverage can. The removable strip may emend over one edge of a rim of a beverage can or over opposite edges of a rim to provide one or two gripping parts for lifting the cover off a beverage can to which it is fitted. The strip may be made of a flexible material, for example a thread, a string, a thin rope, a flat strip, a wire or be of any other suitable form.

Although in the specification reference is made to a "beverage can" this expression also includes a can containing any other goods, such as foodstuffs.

BRIEF DESCRIPTION OF DRAWINGS

The invention will now be described by way of example with reference to the accompanying schematic drawings.

In the drawings there is shown in.

DETAILED DESCRIPTION OF DRAWINGS

Figure 1:
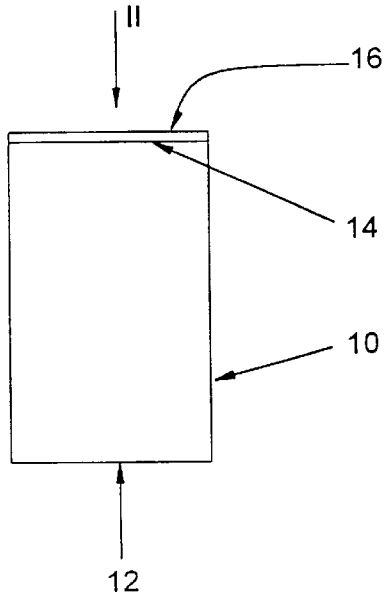
FIG. 1 a side view of a beverage can provided with a first embodiment of a cover in accordance with the invention.
Figure 2:
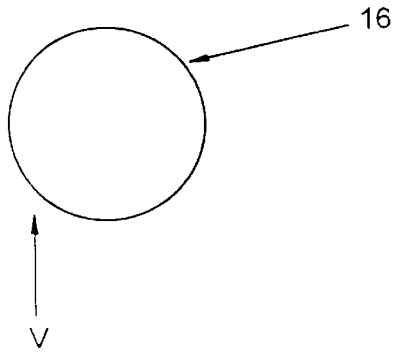
FIG. 2 a plan view seen along arrow 11 in FIG. 1.

Referring to FIGS. 1 and 2 a beverage can 10 is shown, which has a closed bottom end 12 and a closed top end 14, the top end 14 being covered by means of a first embodiment of a cover generally indicated by reference numeral 16.

Figure 5:
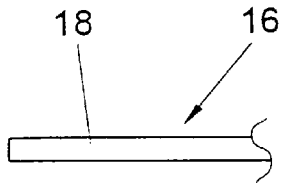
FIG. 5 on a slightly increased scale, a side view of part of the cover as seen along arrow V in FIG. 2 and constituted by a single layer or foil.
Figure 6:
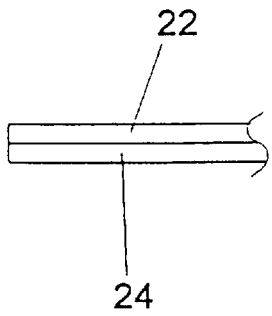
FIG. 6 a view corresponding to FIG. 5 but showing a cover constituted by laminated folls or layers.

The cover 16 is of round circular shape and is in disc form. It may be constituted by a single layer or foil 18 as shown in FIG. 5 or by way of a laminated construction 20 comprising two layers 22, 24 laminated together as illustrated in FIG. 6.

The cover 16 is attached to the top 14 of the can 10 by way of glueing, heat sealing, laser welding, or in any other suitable manner.

The cover 16 may be made of any suitable material, such as plastics or metal foil.

Figure 3:
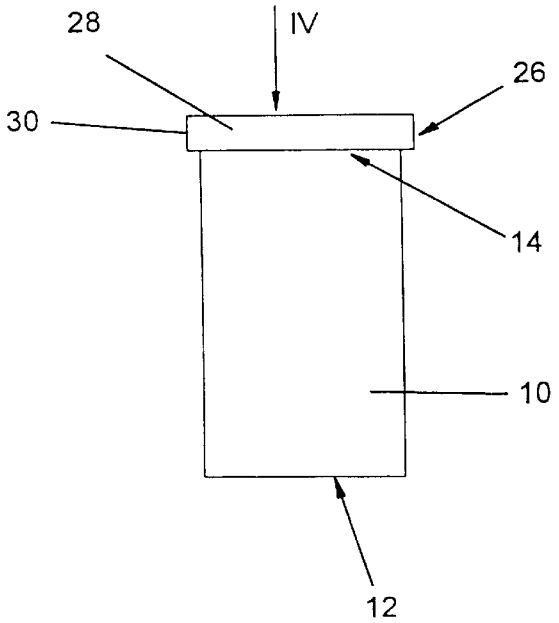
FIG. 3 a side view of a beverage can provided with a second embodiment of a cover in accordance with the invention.
Figure 4:
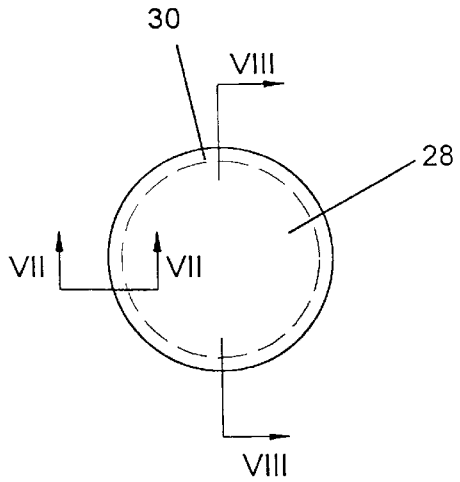
FIG. 4 a plan view seen along arrow IV in FIG. 3.
Figure 7:
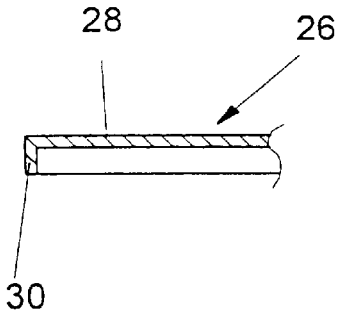
FIG. 7 a sectional side view of the cover seen along arrows VII—VII in FIG. 4.

Referring now the FIGS. 3, 4 and 7 the can 10 is closed off at its upper end 14 by means of a second embodiment of a cover 26. The cover 26 is constituted by a disc shaped part 28 and an annular collar 30, which is downwardly directed and fits around the top end of the can 10.

Figure 8:
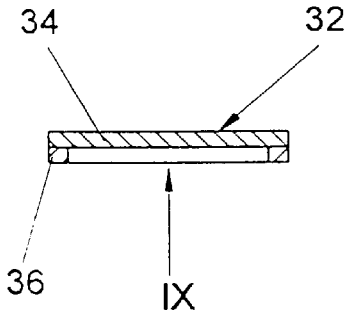
FIG. 8 a sectional side view of a third embodiment of a cover in accordance with the invention provided with a ring for attachment purposes and as seen along arrows VIII—VIII in FIG. 4.
Figure 9:
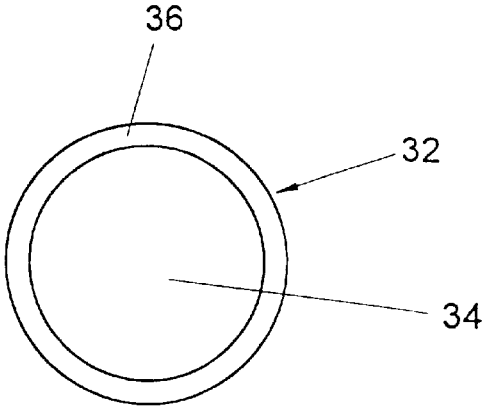
FIG. 9 a view from below seen along arrow IX in FIG. 8.

In FIGS. 8 and 9 a third embodiment of a cover 32 is shown, which is constituted by a disc shaped part 34 and an annular ring 36 joined thereto or formed integrally therewith.

Figure 10:
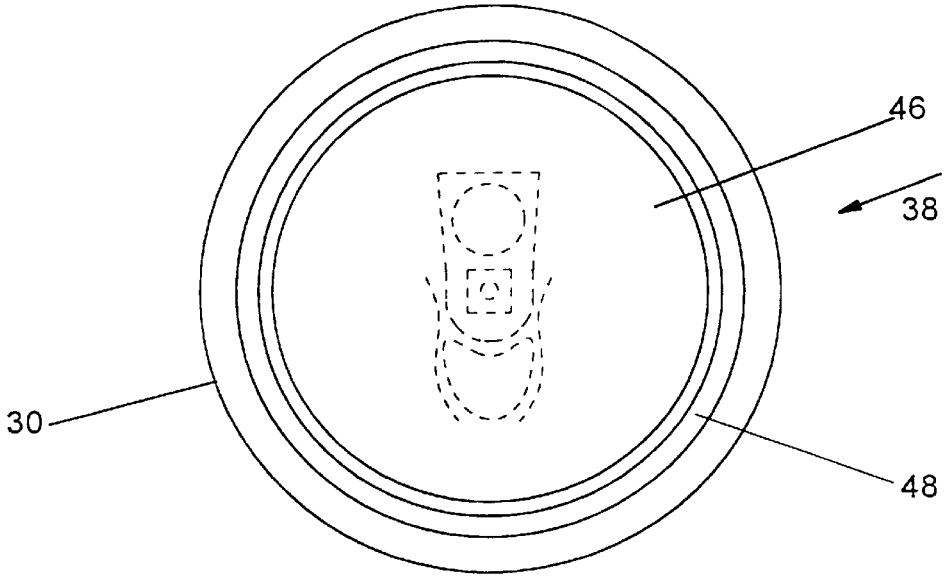
FIG. 10 a plan view of a beverage can provided with a fourth embodiment of a cover in accordance with the invention.
Figure 11:
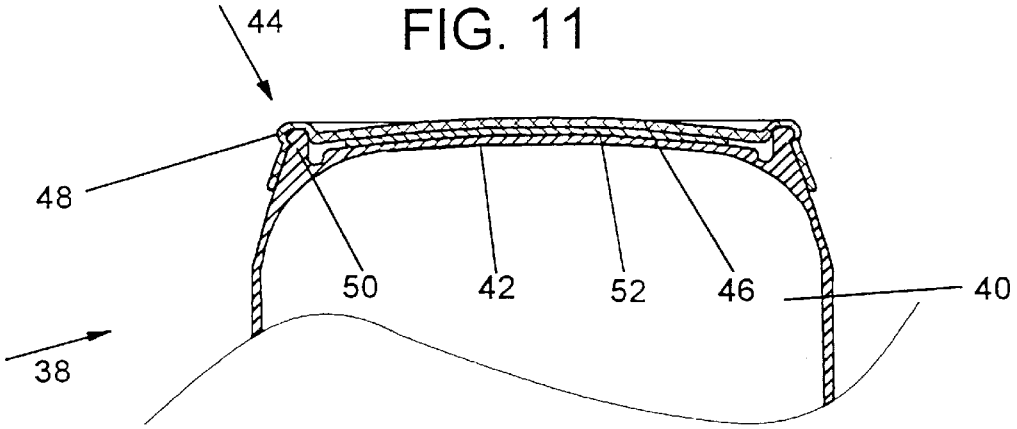
FIG. 11 a side view seen along arrow XI in FIG. 10.

Referring to FIGS. 10 and 11, a beverage can 38 is shown, which has a cylindrical housing 40 and a closed top end or lid part 42, the top end 42 being covered by means of a cover in accordance with a third embodiment is of the invention generally indicated by reference numeral 44.

The cover 44 is constituted by a disc part 46 and, formed integrally therewith, a circumferential collar 48. In use the collar 48 fits tightly over the upper circumferential edge or rim 50 of the can 38 and the disc part 46 fits over the lid part 42. If required any promotional material 52, e.g., a condom, as set out before may be placed between the disc part 46 and the lid part 42.

Figure 12:
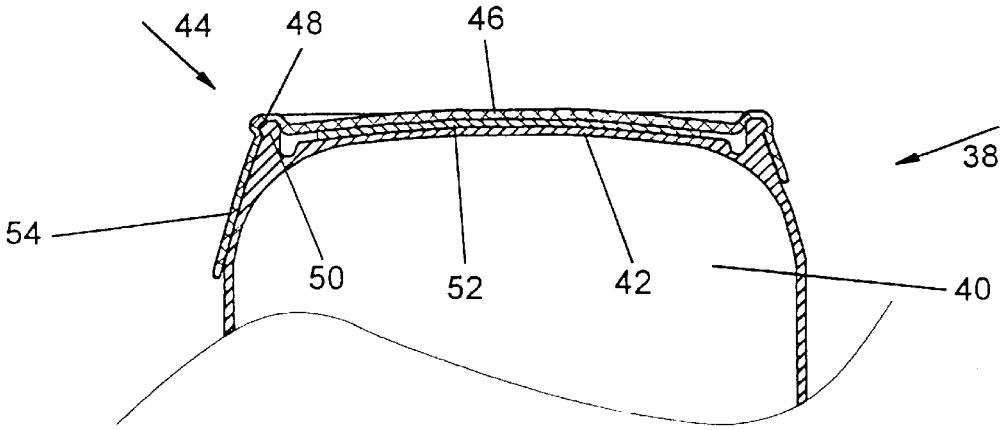
FIG. 12 a side view corresponding to FIG. 2 but showing a fourth embodiment of a cover in accordance with the invention.

As shown in FIG. 12, the cover 44 may be provided with a lug or tongue 54 extending from the collar 48, by means of which the cover 44 can be pulled off the rim or edge 50 of the can 38 so as to reach the promotional material 52.

Figure 13:
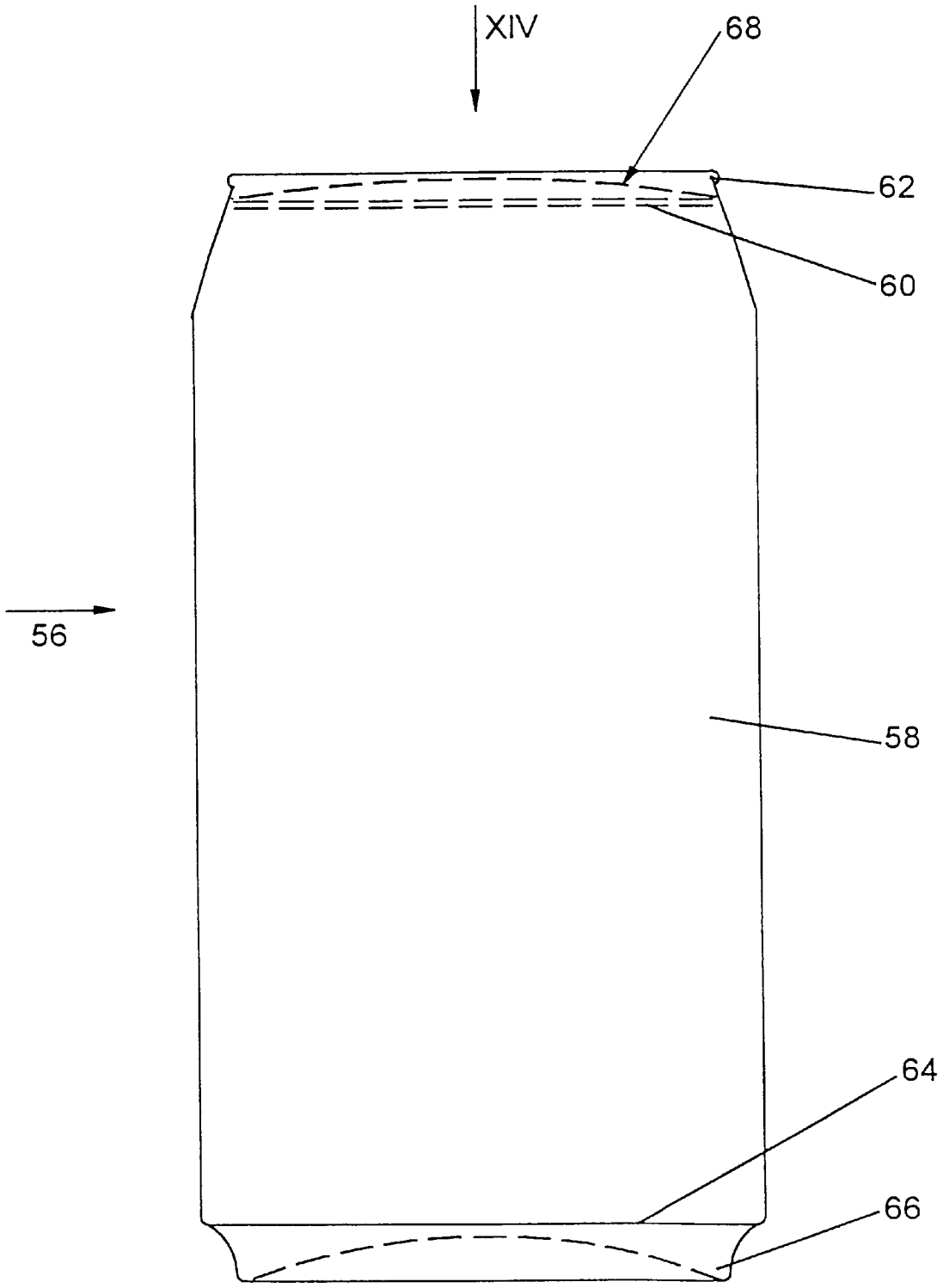
FIG. 13 a side view of a beverage can provided wit various embodiments of a cover in accordance with the invention and as shown in FIGS. 14 to 24.
Figure 14:
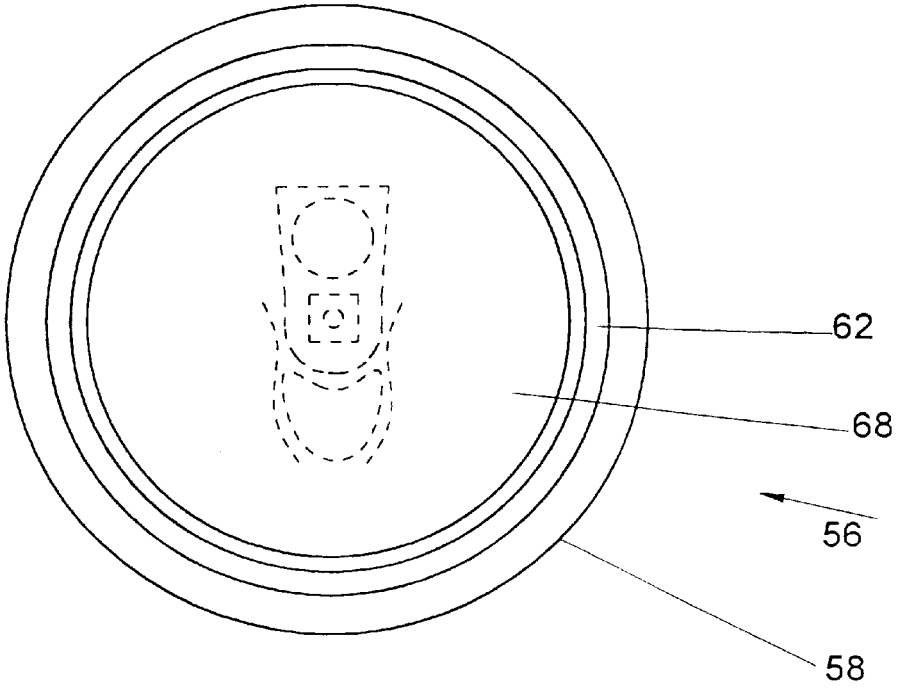
FIG. 14 a plan view seen along arrow XIV in FIG. 13.
Figure 15:
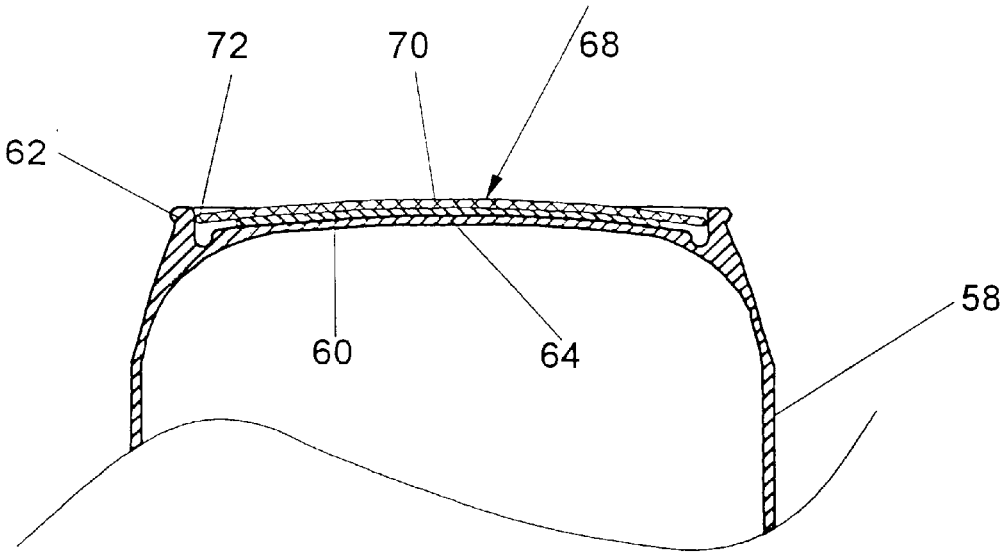
FIG. 15 a sectional side view seen along arrows XV—XV in FIG. 14.

Referring to FIGS. 13 to 15, a beverage can 56 is shown which has a cylindrical housing 58, a top lid part 60, with a circumferential rim 62, and a bottom floor part 64 with a circumferential rim 66.

The cover 68 includes a disc 70 which is pressed into position so that its circumferential edge 72 engages tightly with the inside of the rim 62.

Promotional material 64 can be placed between the cover 68 and the lid part 60 (FIG. 15).

Figure 16:
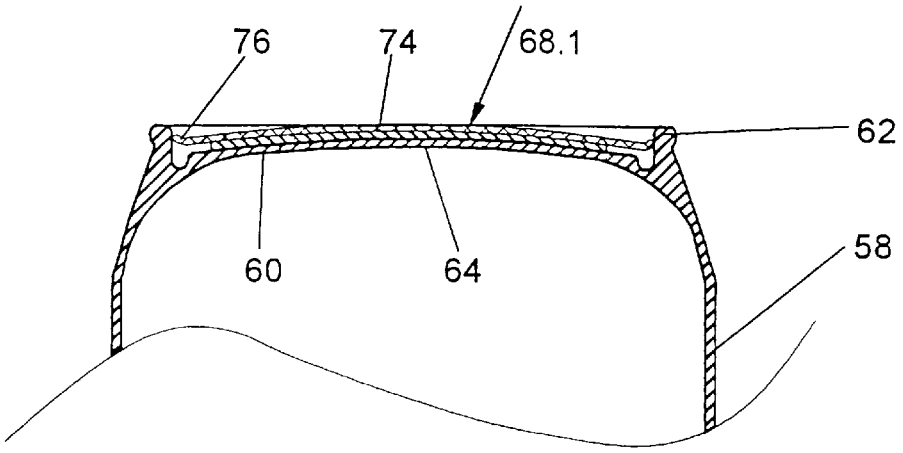
FIGS. 16 to 24 a sectional side views corresponding to FIG. 15 but showing various other embodiments of a cover in accordance with the invention.

In FIGS. 16 to 24 different embodimnet of other covers 68.1 . . . 68.9 in accordance with the invention are shown fitted to a can 56 as illustrated in FIGS. 13 to 15. These covers 68.1 . . . 68.9 are characterized as follows:

The cover 68.1 has a disc 74 with a circumferential rim 76 which is directed upwardly and which assists in fitting the cover 68.1 to the rim 62 (FIG. 16).

Figure 17:
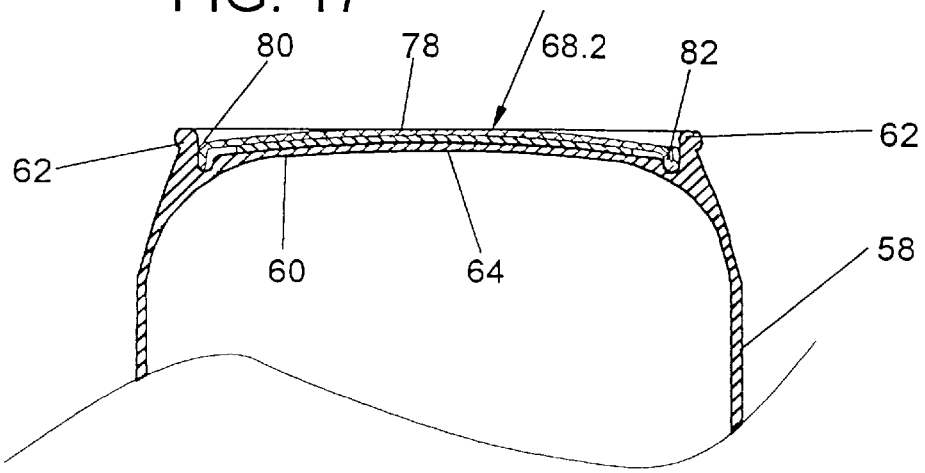

The cover 68.2 has a disc 78 with a circumferential rim 80 to facilitate fitting to the inside of the rim 62. On one side it has an additional lip 82 to assist such fitting (FIG. 17).

Figure 18:
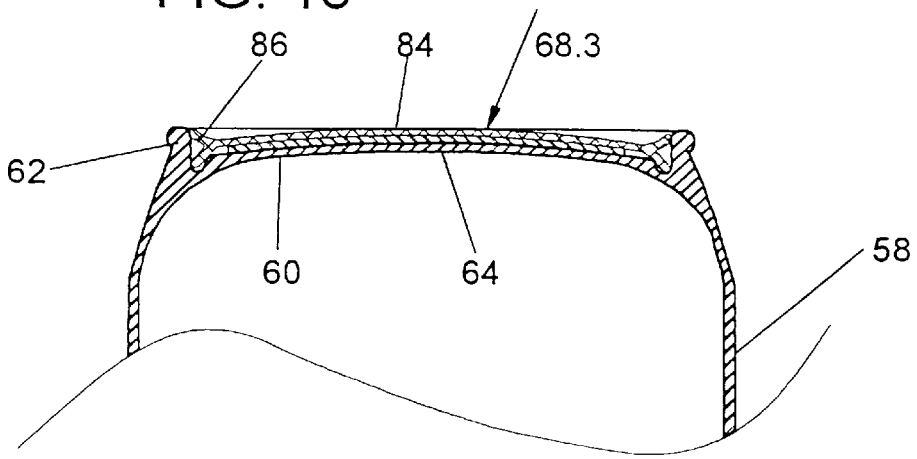

The cover 68.3 has a disc 84 with a circumferential V-shaped projection 86, which also assists in fitting the cover 68.3 to the rim 62 (FIG. 18).

Figure 19:
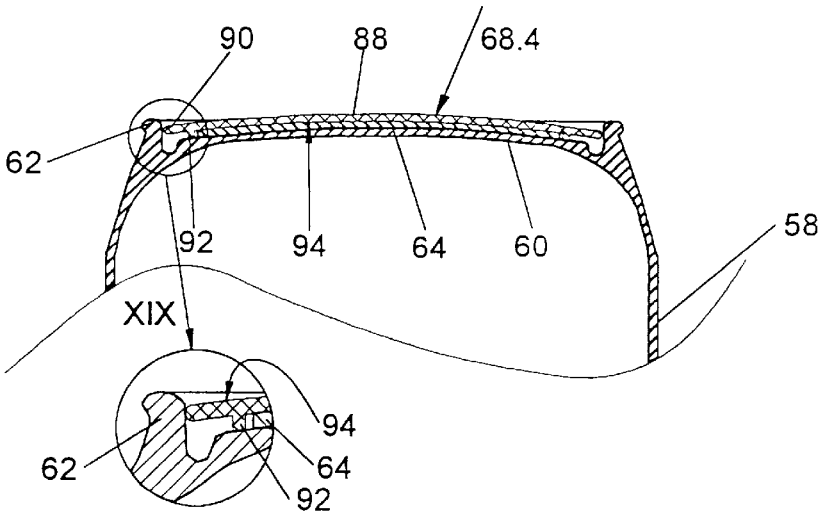

The cover 68.4 has a disc 88 with a circumferential edge 90, and a downwardly directed collar 92 projecting from the face 94 of the cover disc 88. The circumferential edge 90 of the disc 88 engages with the rim 62. The collar 92 spaces the disc 88 away from the lid part 60 to provide a space for accommodating promotional material 64 (FIG. 19). For clarity an enlargement is shown as indicated by arrow XIX.

Figure 20:
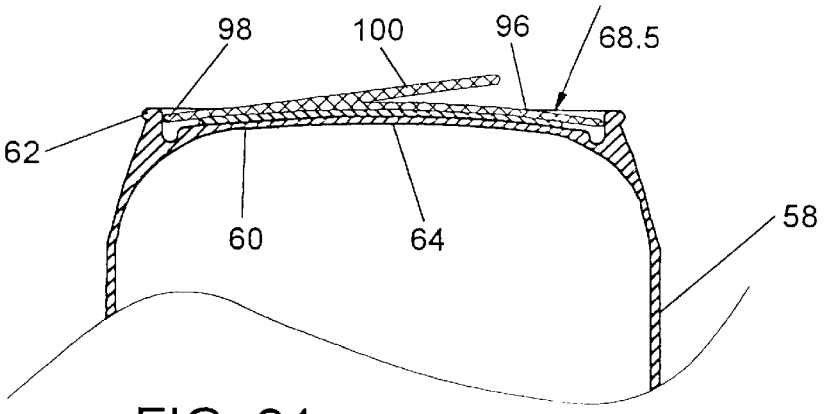

The cover 68.5 Includes a disc 96 which is fitted by way of its circumferential edge 98 to the inside of the rim 62. A lug or tongue 100 is provided on the disc 96 or is joined thereto, and projects upwardly. The lug or tongue 100 serves for assisting in lifting and removing the cover 68.5 (FIG. 20).

Figure 21:
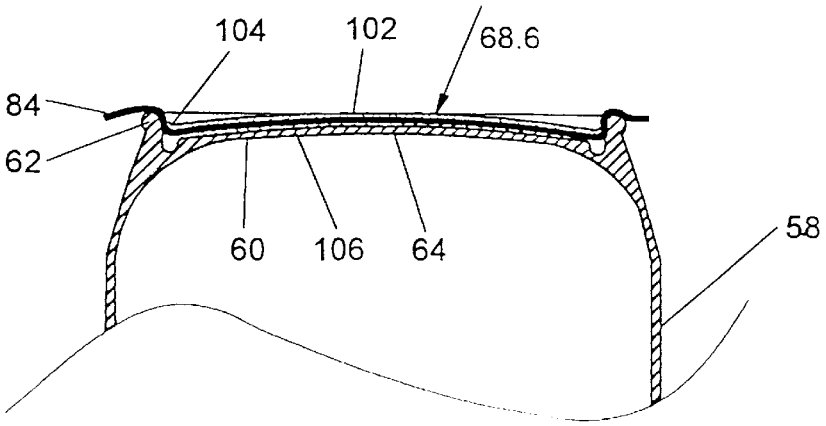

The cover 68.6 includes a disc 102 and is fitted to the inside of the rim 62 by way of its circumferential edge 104. For removal of the cover 34 a string 106 is located between the disc 102 and the lid part 60. The sting 106 projects by way of its extremities 108, 110 over the rim 62 to enable it to be gripped for removal of the cover 68.6. If necessary, only one extremity 108 lies over the edge of the rim 62 (FIG. 21).

Figure 22:
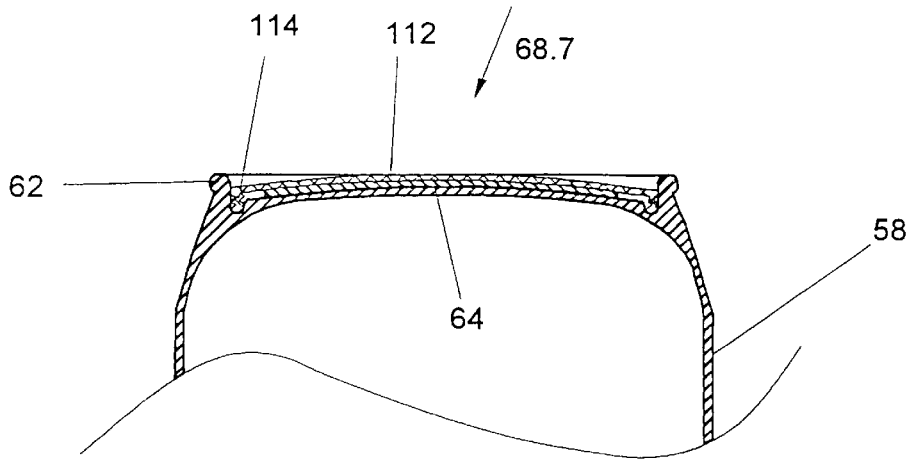

The cover 68.7 has a disc 112 and at its circumferential edge is provided with a threaded collar 114 which is adapted to be screwed on the inside face of the rim 62 (FIG. 22). If required, the rim 62 may have a cooperating screw threaded formation.

Figure 23:
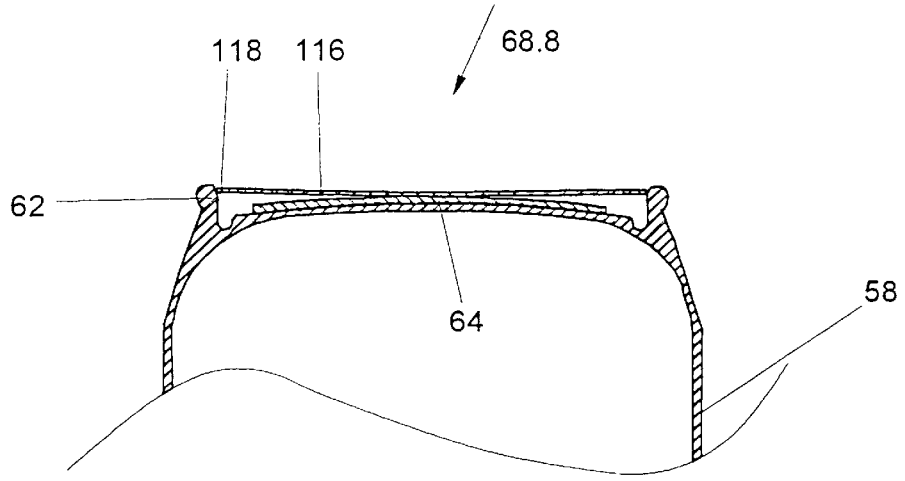

The cover 68.8 has a disc 116 which is of convex shape and is adapted to be pressed into the space between the rim 62 so that the circumferential edge 118 of the disc 116 can engage tightly with the rim 62 (FIG. 23).

Figure 24:
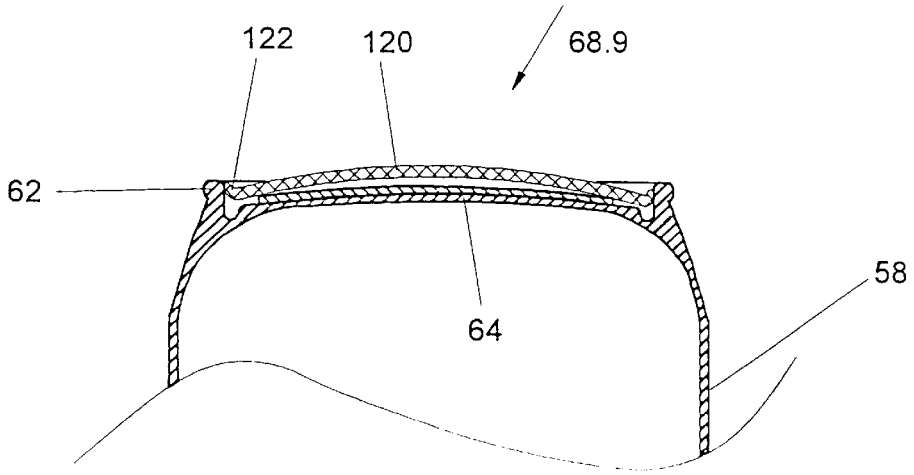

The cover 68.9 includes a concave disc 120 and is adapted to be pushed into position onto the rim 62 so that its circumferential edge 122 engages with the inside of the rim 62 (FIG. 24).

I claim:

1. A cover assembly for a beverage can comprising a cylindrical housing, a floor and, opposed to said floor, a lid part, said cover assembly including a disc comprising a disc part and a circumferential collar formed integrally therewith, the collar being adapted to fit mechanically tightly against the lid part of the cylindrical housing of the beverage can so that the disc part covers the lid part of the beverage can, and promotional material comprising at least one condom arranged adjacent to the disc part and adapted to be located between the disc part and the lid part of the beverage can.

2. A cover assembly as claimed in claim 1, in which the circumferential collar is welded to the lid part of the cylindrical housing of the beverage can.

3. A cover assembly as claimed in claim 1, further comprising a tongue for removal from the beverage can to which the cover assembly is fitted.

4. A cover assembly as claimed in claim 1, in which the disc part is adapted, in use, to indicate temperature.

5. A cover assembly as claimed in claim 1, wherein the disc is adapted to be fitted mechanically so tightly against an end of the cylindrical housing of the beverage can that the disc has be at last partially destroyed for removal so as to thereby indicate tampering therewith.

6. A cover assembly for a beverage can comprising a cylindrical housing, a lid part at one end of the cylindrical housing and a raised rim circumferentially surrounding the lid part, said cover assembly including a disc comprising a disc member adapted to be fitted mechanically tightly over the lid part of the beverage can between the raised rim of the beverage can so that the disc part covers the lid part of the beverage can, and promotional material comprising at least one condom arranged adjacent to the disc member and adapted to be located between the disc member and the lid part of the beverage can.

7. A cover assembly as claimed in claim 6, in which the disc is welded to said one end of the cylindrical housing of the beverage can.

8. A method of covering a dispensing opening in a lid of a beverage can, said method including the steps of attaching a cover, including a disc and an attachment area associated with the disc for removably attaching the disc to the beverage can, so as to close off the dispensing opening of the beverage can by mechanically tightly fitting the cover over the dispensing opening, and providing promotional material constituted by a separate member comprising at least one condom between the cover and the lid of the beverage can.

9. In combination, a beverage can comprising a cylindrical housing, a floor at a first end of the housing and a lid part at a second, opposite end of the housing, a cover comprising a disc member fit mechanically tightly to the lid part so that the disc member covers the lid part of the beverage can, and a promotional material comprising at least one condom arranged adjacent to the disc member between the disc member and lid part of the beverage can.

10. The combination claimed in claim 9 wherein the cover includes a circumferential collar formed integrally with said disc member and fit mechanically tightly against the lid part of the beverage can so that disc member covers the lid part.

11. The combination claimed in claim 9 wherein the lid part of the beverage can includes a lid portion and a circumferential raised rim surrounding said lid portion, and said disc member is mechanically tightly fit to said circumferential raised rim so that disc member covers said lid portion.

* * * * *